US006897808B1

(12) United States Patent
Murch et al.

(10) Patent No.: US 6,897,808 B1
(45) Date of Patent: May 24, 2005

(54) ANTENNA DEVICE, AND MOBILE COMMUNICATIONS DEVICE INCORPORATING THE ANTENNA DEVICE

(75) Inventors: Ross David Murch, Kowloon; Chun (Samuel) Kuen Ko, Yuen Long, both of (HK)

(73) Assignee: The Hong Kong University of Science and Technology, Kowloon (HK)

( * ) Notice: Subject to any disclaimer, the term of this patent is extended or adjusted under 35 U.S.C. 154(b) by 1023 days.

(21) Appl. No.: 09/649,874

(22) Filed: Aug. 28, 2000

(51) Int. Cl.[7] ..... H01Q 1/38; H01Q 1/24

(52) U.S. Cl. ..... 343/700 MS; 343/846; 343/702

(58) Field of Search ..... 343/700 MS, 846, 343/702; H01Q 1/38, 1/24

(56) References Cited

U.S. PATENT DOCUMENTS

| | | | | | |
|---|---|---|---|---|---|
| 4,410,891 | A | | 10/1983 | Schaubert et al. | 343/700 MS |
| 4,903,033 | A | | 2/1990 | Tsao et al. | 343/700 MS |
| 5,486,836 | A | | 1/1996 | Kuffner et al. | 343/700 MS |
| 5,497,165 | A | * | 3/1996 | Murakami et al. | 340/700 MS |
| 5,519,406 | A | | 5/1996 | Tsukamoto et al. | 343/700 MS |
| 5,646,634 | A | * | 7/1997 | Bokhari et al. | 343/700 MS |
| 5,691,734 | A | | 11/1997 | Davies | 343/795 |
| 5,784,032 | A | | 7/1998 | Johnston et al. | 343/702 |
| 5,923,303 | A | | 7/1999 | Schwengier et al. | 343/853 |
| 5,945,951 | A | | 8/1999 | Monte et al. | 343/700 MS |
| 6,111,549 | A | * | 8/2000 | Feller | 343/795 |

* cited by examiner

*Primary Examiner*—Hoanganh Le
(74) *Attorney, Agent, or Firm*—Burns Doane Swecker & Mathis LLP

(57) ABSTRACT

A compact integrated antenna device is described which has two feed ports. The antenna device has a Y-shaped transmission plate spaced from a parallel grounded plate, and the feed ports are connected to the transmission plate at locations on the transmission plate which are on different branches of the Y-shape. The antenna device can be utilized in compact wireless communication handsets to provide diversity signals or act as a duplexer allowing the receive and transmit signals to be mutually isolated.

14 Claims, 10 Drawing Sheets

ANTENNA DEVICE, AND MOBILE COMMUNICATIONS DEVICE INCORPORATING THE ANTENNA DEVICE

FIELD OF THE INVENTION

The present invention relates to an antenna device, and a mobile communications device incorporating the antenna device.

BACKGROUND OF THE INVENTION

The performance of wireless communication systems can be greatly enhanced by utilizing antenna diversity or smart antennas. Such antenna systems make use of multiple antennas and they have been incorporated into the base stations of most mobile telephone systems in use today.

Adoption of diversity or smart antennas in compact wireless communication handsets however has not been widespread, although several investigations have been reported. Possible explanations for this are that the volume of dual or multiple antennas is currently too large for modern compact handsets and that the improved performance of the handset does not sufficiently compensate for increases in receiver complexity.

Some of these issues are being addressed and recently developed antenna algorithms such as BLAST (Bell laboratories layered space-time) may overcome the complexity verses performance issue (G. J. Foschini, "Layered Space-Time Architecture for Wireless Communication in a Fading Environment when Using Multi-Element Antennas", Bell Labs Technical Journal, Vol 1, No.2, Autumn 1996, pp.41–59). However the antenna volume that dual or multiple antennas occupy remains a problem. In previous work significant reductions in antenna size have been achieved for individual antennas (see for example the following documents, the disclosure of which is incorporated herein by reference: M. T. K. Tam and R. D. Murch, "Compact Sector and Annular Sector Dielectric Resonator Antennas", IEEE Transactions on Antennas and Propagation, Vol. 47, No.5, May 1999, pp.837–842; C. R. Rowell and R. D. Murch, "A compact PIFA suitable for dual frequency 900/1800 MHz operation", IEEE Transactions on Antennas and Propagation, Vol 46, No.4, April 1998, pp.596–598; M. A. Jensen and Y. Rahmat-Samii, "Performance analysis of antennas for hand-held transceivers using FDTD", IEEE Transactions on Antennas and Propagation, Vol. 42, No.8, August 1994, pp.1106–1113; M. G. Douglas, M. Okoniewski, M. A. Stuchly, "A planar diversity antenna for hand-held PCS devices", IEEE Transactions on Vehicular Technology, Vol. 47, No.3, August 1998, pp. 747–54; and G. F. Pedersen and J. B. Andersen, "Integrated antennas for hand-held telephones with low absorption", IEEE Vehicular Technology Conference, June 1994, pp. 1537–1541), however compact diversity antennas have not been well studied. The current approach to achieve antenna diversity at the handset is based on placing two or more individual compact antennas on the handset in positions that provide low envelope cross-correlation coefficients (see the papers by M. A. Jensen et al. and M. G. Douglas et al. mentioned above).

This approach is good but the overall volume the antennas occupy increases directly with their number and becomes too large for compact handsets.

SUMMARY OF THE PRESENT INVENTION

The present invention seeks to provide a new and useful antenna device, and a mobile communications unit incorporating the antenna device.

In general terms, the present invention proposes that the transmission plate of an antenna device is Y-shaped, with connection ports connected to the transmission polate near the centre of the Y-shape on either side of the central axis. The connection ports can be used to receive/transmit respective signals.

Thus, the present antenna design may be regarded as effectively incorporating two antennas (the two antennas sharing one branch of the Y-shape) into one, while still maintaining good isolation between the ports, low envelope cross-correlation and also compact size. In fact, the antenna may be considered as a combination of two patch antennas, as discussed in detail below.

An embodiment of the present invention may employ capacitive loading (as described for example in C. R. Rowell and R. D. Murch, "A Capacitively loaded PIFA for compact mobile telephone handsets", IEEE Transactions on Antenna and Propagation, Vol 45, No.5, May 1997, pp.837–42) providing compact designs which are well suited for a diversity antenna system in a mobile telephone.

The present antenna may be utilized as a duplexer allowing the receive and transmit signals to have separate signal paths with more than 20 dB isolation providing similar performance to those based on a square patch, but with reduced volume.

BRIEF DESCRIPTION OF THE FIGURES

An embodiment of the invention will now be described for the sake of example only with reference to the accompanying figures in which.

DETAILED DESCRIPTION OF EMBODIMENTS

1. Formalism for Analysing the Present Embodiments

Figure 1:
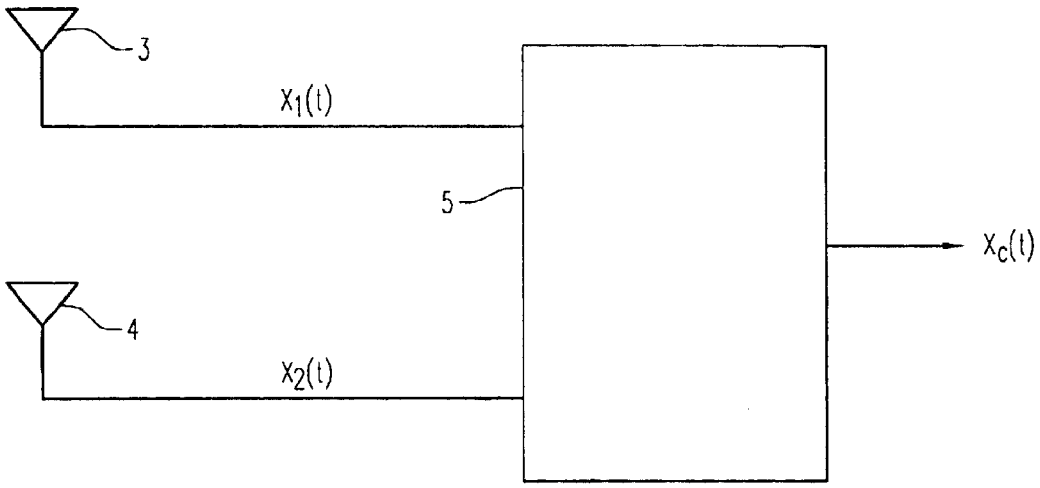
FIG. 1 shows a known dual antenna diversity system.

A dual antenna diversity antenna system is illustrated in FIG. 1. This includes two antennas 3, 4 which generate respective narrowband received voltage signals denoted by $x_1(t)$ and $x_2(t)$ (in complex baseband representation). These signals are passed to a combining/processing block 5 to reduce channel distortions such as fading and co-channel interference (CCI) creating an improved signal $x_c(t)$ (as described in J. C. L. Ng, K. B. Letaief and R. D. Murch, "Antenna Diversity Combining and Finite-Tap Decision Feedback Equalization for High-Speed Data Transmission", IEEE Journal on Selected Areas in Communications, Vol. 16, No.8, October 1998, pp.1367–1375; J. H. Winters, "Signal Acquisition and Tracking with Adaptive Arrays in the Digital Mobile Radio System IS-54 with Flat Fading", IEEE Transactions on Vehicular Technology, Vol. 42, No.4, November 1993, pp.277–384; and R. G. Vaughan, "On Optimum Combining at the Mobile", IEEE Transactions on Vehicular Technology, Vol. VT-37, No.4, November 1988, pp.181–8).

The amount of reduction in signal fading (or diversity gain) possible depends on the cross-correlation and relative signal strength levels between the received signals $x_1(t)$ and $x_2(t)$. To quantify these conditions one defines the average received signal strength at each of the antenna branches as:

$$P_1=E(|x_1(t)|^2)\ P_2=E(|x_2(t)|^2) \tag{1}$$

where E is used to denote expectation. Additionally, we define the complex cross-correlation between the signals as:

$$\rho_c=\frac{E[(x_1(t)-\bar{x}_1)(x_2(t)-\bar{x}_2)^*]}{\sqrt{E[|x_1(t)-\bar{x}_1|^2]E[|x_2(t)-\bar{x}_2|^2]}} \tag{2}$$

where * is the complex conjugate and the bar indicates a time average. We also find it useful to refer to the envelope cross-correlation $\rho_e$ between the signals and this is related to the complex cross-correlation by $$\rho_e=|\rho_c|^2 \tag{3}$$

under the assumption the received signals have a Rayleigh distributed envelope and randomly distributed phase.

Using these definitions good diversity gain is said to be possible (e.g. in R. G. Vaughan and J. B Andersen, "Antenna Diversity in Mobile Communications", IEEE Transactions on Vehicular Technology, Vol. VT-36, No.4, November 1987, pp.147–72) when the received signals satisfy the conditions $$\rho_e<0.5$$

and $$P_1\approx P_2. \tag{4}$$

These parameters can be calculated directly by measuring the received antenna signals in a typical wireless environment. They can also be obtained from the radiation patterns and mutual coupling between antenna ports.

Using the derivation in the paper of R. G. Vaughan et al mentioned above, the radiation patterns can be used to evaluate the cross-correlation $\rho_c$ and a simplified form of the expression (2) can be written (see M. A. Jensen et al referred to above) as $$\rho_c=\frac{\int_0^{2\pi}A_{12}(\phi)d\phi}{\left[\int_0^{2\pi}A_{11}(\phi)d\phi\int_0^{2\pi}A_{22}(\phi)d\phi\right]^{1/2}} \tag{5}$$

where $A_{mn}(\phi)=\Gamma E_{\Theta m}(\pi|2,\phi)E^*_{\partial n}(\pi|2,\phi)+E_{\Phi m}(\pi|2,\phi)E^*_{\Phi n}(\pi|2,\phi)$ in which $E(\theta,\phi)=E_{\Theta,m}(\theta,\phi)\hat{\theta}=E_{\Phi m}(\pi|2,\phi)\hat{\phi}$ is the antenna gain (electric field) pattern of antenna m=1,2 and $\Gamma$ is the cross polarization discrimination (XPD) (ratio of vertical to horizontal electric field strength) of the incident field, and is normalised to 1 by an integration over $\theta$ and $\phi$. The derivation of (5) is predicated on the fading envelope being Rayleigh distributed, the incoming field arriving in the horizontal plane only, the incoming field's orthogonal polarizations being uncorrelated, the individual polarizations being spatially uncorrelated and finally that the time-averaged power density per steradian is constant. We define this set of conditions as the "mobile wireless environment" and it is recognised that this is reasonably representative of the incoming field around a mobile telephone handset.

Estimates of the relative signal strengths in (1) can also be obtained from the antenna patterns using mean effective gain (MEG). MEG is defined as the ratio of the power received by the antenna along some random route to the total mean power incident to the antenna along the same route. Using the definition of the mobile wireless environment introduced in the previous paragraph the MEG can be written as $$MEG=\int_0^{2\pi}\left[\frac{\Gamma}{1+\Gamma}E_\theta(\pi/2)+\frac{1}{1+\Gamma}E_\phi(\pi/2,\phi)\right]d\phi \tag{6}$$

If the antennas are 100% efficient the maximum MEG is −3 dB (see G. F. Pedersen and J. B. Andersen, "Handset Antennas for Mobile Communications: Integration, Diversity and Performance", Review of Radio Science 1996–1999, August 1999, pp.119–133). However in our definition the antenna gains have an efficiency of less that 1, and therefore MEG will always be less than −3 dB and can be as low as −12 dB in the presence of the human head. To ensure that the signal strength from both antennas satisfies $P_1\approx P_2$ we calculate the ratio of the MEG from the two antennas ($MEG_1/MEG_2$) and make certain it is close to unity (normally within ±3 dB). The correlation between the antenna ports can also be obtained from the mutual coupling using the normalized mutual resistance $r_{ij}=Re(Z_{ij})/Re(Z_{ij})$ (where $Z_{ij}$ are the standard two port impedances) using the expression (see the paper of R. G. Vaughan et al mentioned above):

$$\rho_c\approx r_{ij} \tag{7}$$

In diversity antenna prototyping this expression provides a quick method to method cross correlation from the antenna terminal charateristics alone.

In general the results in (2), (5) and (7) are equivalent under the mobile wireless environment assumption and should provide consistent estimates of cross-correlation $\rho_c$.

2. Concepts Underlying the Embodiments

Figure 2:
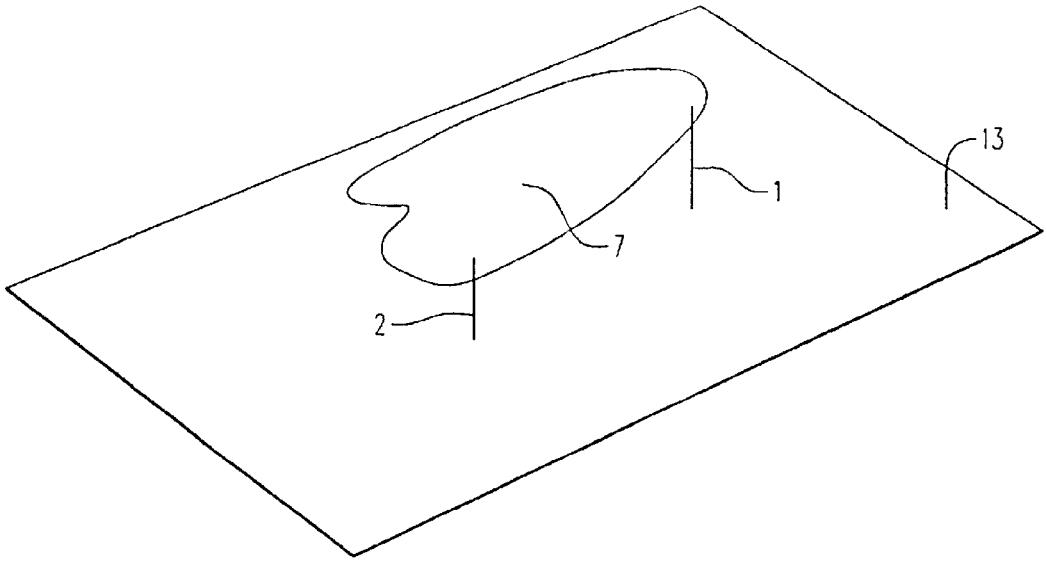
FIG. 2 is a schematic representation of a basic planar integrated diversity antenna.

The general geometry of an antenna with two feeds is shown in FIG. 2. It consists of a planar "patch" antenna 7 which may be of any shape (and supported by short posts if desired) with two feeds 1, 2 which meet the antenna 7 at feed positions. A parallel ground plate 13 is also provided. The present inventors have attempted to determine a shape of the patch 7 and feed positions which meet our diversity criteria (4) while maintaining compact dimensions.

The present inventors have noted how the geometry of the antenna affects the diversity characteristics. This is most easily performed by exploiting the link (noted in D. M. Pozar, "Input Impedance and Mutual Coupling of Rectangular Microstrip Antenna", IEEE Transactions on Antenna and Propagation, Vol 30, No.6, November 1982, pp1191–6; and E. Penard and J. P. Daniel, "Mutual coupling between microstrip antennas", Electronics Letters, Vol 18, No.14, Jul. 8, 1982, pp.605–7) between mutual coupling and correlation through equation (7). Consequently an understanding of how the geometry affects the mutual coupling will provide us directly with an understanding of how it affects the signal cross correlation.

Mutual coupling $Z_{12}$ can be found with reference to the reaction theorem (see the article by Penard et al mentioned above, as well as C. A. Balanis, Antenna Theory: Analysis and Design 2nd edition, New York, N.Y.:Wiley, 1997) and expressed as:

$$Z_{12} = \frac{1}{I_1 I_2}\int (H_1 \cdot M_2 + E_1 \cdot J_2)dV \tag{8}$$

where $I_1$ and $I_2$ are the feed currents flowing into feed 1 and 2 respectively, vectors $H_1$ and $E_1$ are the magnetic and electric fields associated with feed 1 while vectors $M_2$ and $J_2$ are any magnetic and electric sources associated with feed 2. The integral term in (8) is known as the reaction and satisfies reciprocity so that the subscripts 1 and 2 may be interchanged to give an equivalent expression. We note that the mutual coupling can be minimized by reducing the couplings between the fields and the sources so that the reaction is as close to zero as possible.

The reaction component in (8) is generally difficult to calculate and several approximate solutions for couplings between planer antennas have been obtained by invoking an equivalent cavity model in which equivalent magnetic sources are placed around the edges of the patch (see the article by Penard et al mentioned above). Evaluation of this expression leads to useful accuracy but does not lead to much intuitive insight.

Here the present inventors prefer to use actual source representations on the patch and probes. That is we configure the space for which we apply the reaction theorem as that consisting of free space and the conductors which form the antennas. Current sources $J_1$ and $J_2$ are set up to represent the two probe fields and these are the only sources in the problem space so that (8) reduces to $$Z_{12} = \frac{1}{I_1 I_2}\int E_1 \cdot J_2 dV \tag{9}$$

By relating $E_1$ to the induced voltage $V_1$ at feed 2 and $J_2$ to the current $I_2$ flowing through feed 2, the reaction can be further simplified to $V_1 I_2$. Therefore to achieve low mutual coupling the voltage induced by feed 1 at the position of feed 2 should be as small as possible.

The mutual coupling at any point on the patch can therefore by approximately quantified from the voltage distribution on it. For example a voltage null would indicate the mutual coupling was very weak.

Figure 3:
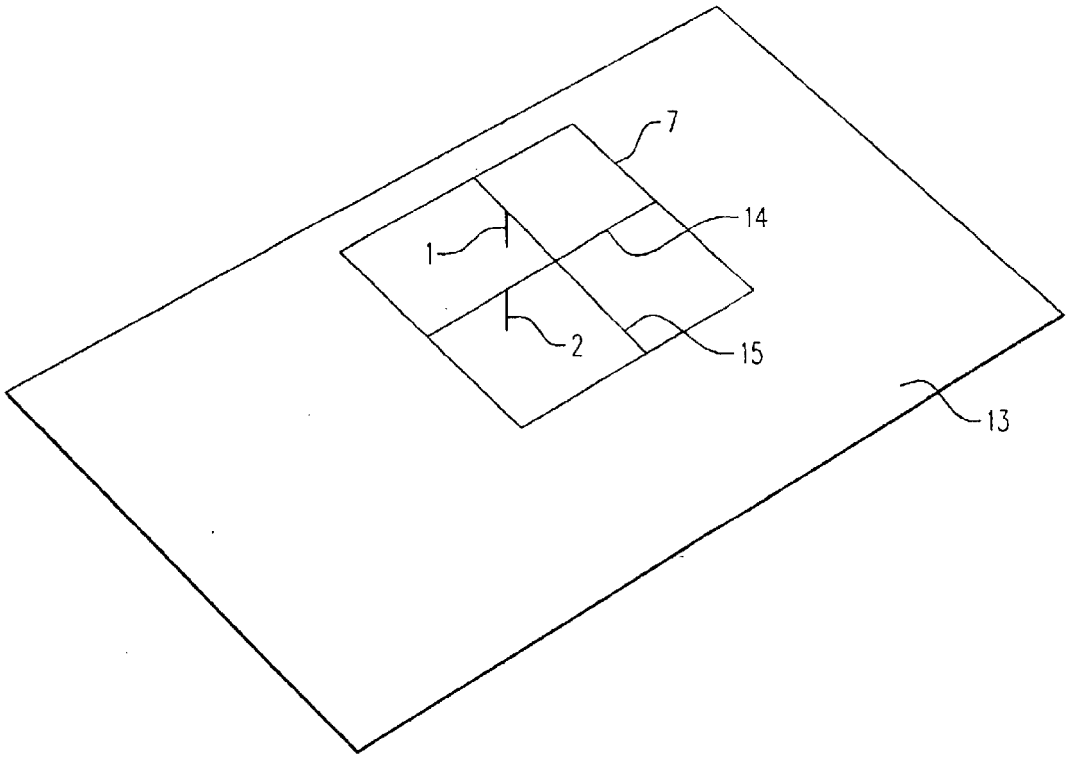
FIG. 3 shows a known dual polarized patch antenna.

In conventional rectangular patch antennas a voltage null usually occurs somewhere in the middle of the patch, and in FIG. 3 null voltage lines for the voltages induced by feeds 1 and 2 on a square patch 7 are shown respectively as lines 14 and 15. Placing the feed at any position on a null line corresponding to the other feed will produce low mutual coupling. This is exploited in B. Lindmark, "A novel dual polarized aperture coupled patch element with a single layer feed network and high isolation", IEEE Antennas and Propagation Society International Symposium, Vol 4, 1997, pp.2190–3; L. Habib, G. Kossiavas and A. Papiernik, "Cross-shaped patch with etched bars for dual polarization", Electronics Letters, Vol 29, No.10, May 13, 1993, pp.916–18; and M. J. Cryan, P. S. Hall, S. H. Tsang and J. Sha, "Integrated Active Antenna with Full Duplex Operation", IEE Transactions on Microwave Theory and Technology, Vol 45, Vol 45, No.10, October 1997, pp.1742–8.

In addition to this criteria it is desirable to achieve a 50Ω match for each port (50Ω is a standard antenna impedance value) and this can be achieved by moving the feed along the null line until a good match is achieved. In general as long as the null lines each occupy a point where a good impedance match can be achieved then an antenna with good isolation will be possible. An implication of this is that the null lines should not significantly overlap since a null line appears as a short circuit for the antenna generating it.

Using this interpretation of the coupling we can more easily directly design antennas using our intuition. For example we can quickly understand why it is difficult to merge two PIFA antennas (that is, planar inverted F-antennas) together to achieve low mutual coupling. A PIFA antenna does not have any naturally occurring voltage null lines with well matched feed positions and therefore it is difficult to achieve a good diversity antenna.

3. Geometry of the Present Embodiments and Simulation Results

Figure 4A:
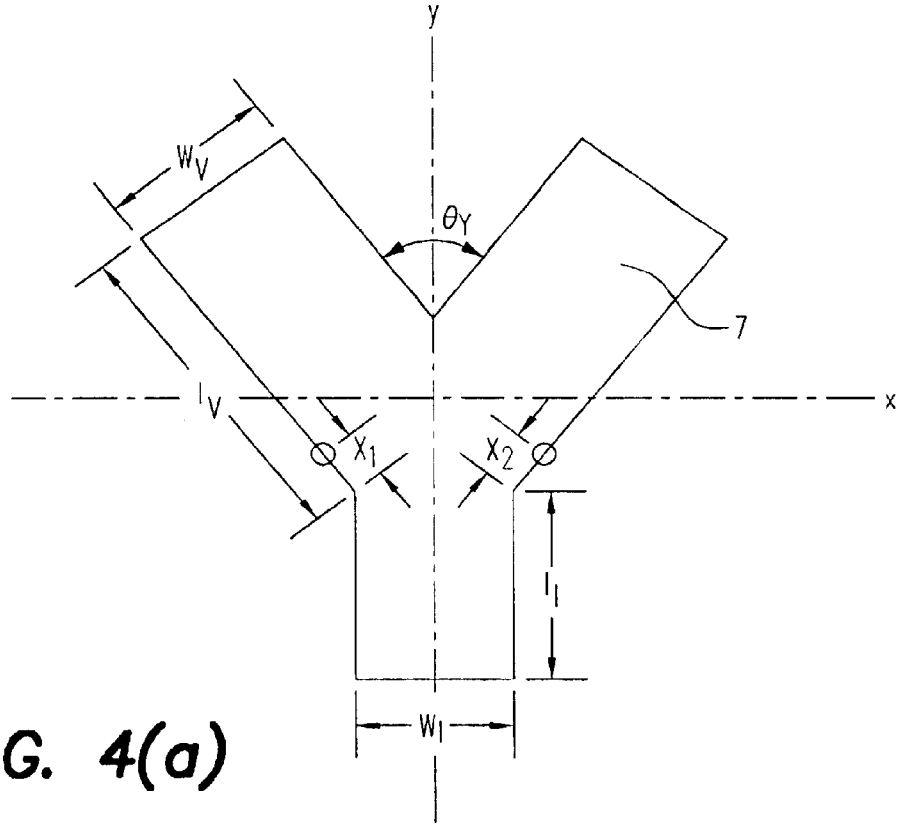
FIGS. 4(*a*)–(*b*) shows the geometry of a first embodiment of an antenna device according to the present invention, in (*a*) planar view, and (*b*) perspective view.
Figure 4B:
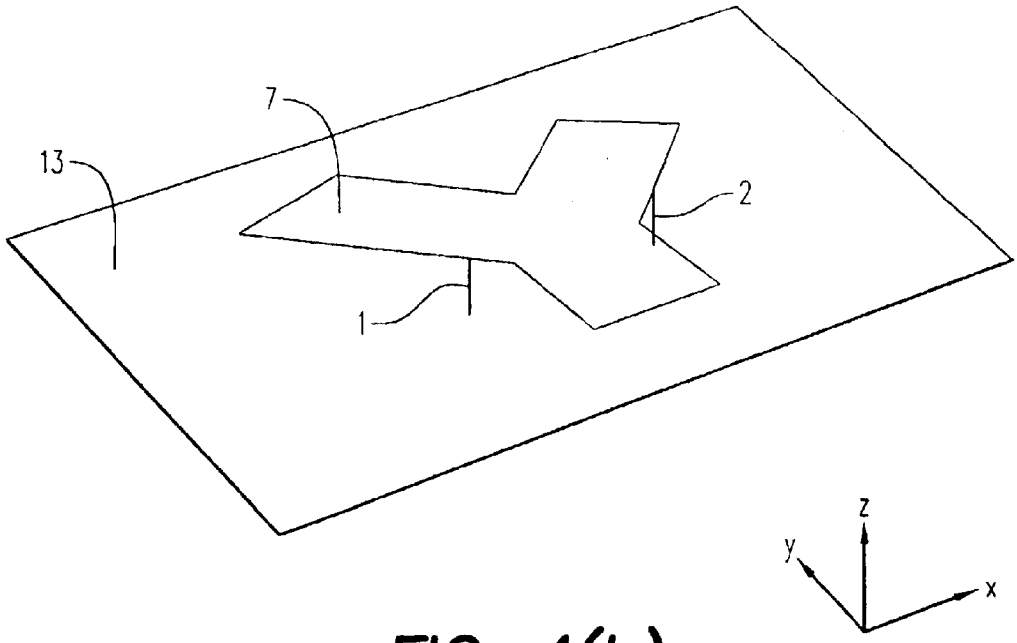

Using the ideas in the previous section we have attempted to design a compact diversity antenna by merging two rectangular patch antennas together. The basic geometry for the first embodiment of our antenna is shown in FIGS. 4(*a*) and 4(*b*). The patch (transmission plate) 7 is essentially a Y-shaped patch with three branches extending from a central position. The patch 7 is substantially symmetric abput a line of symmetry along the y-axis. The feeds (connection portions) 1, 2 are on either side of the y-axis, at or near the edge of the patch 7. The patch 7 is parallel to, and spaced by a distance h from, the ground plate 13.

Normally each of the feeds 1, 2 is a single electrical conductor which is part of a respective port having two electrical conductors. In practice the port may be a coaxial cable—the inner conductor being extended to form the feed to the transmission plate, and the outer conductor being directly connected to the ground plate 13 (at a location directly underneath the connection to the transmission plate 7).

The antenna can be thought of as two approximately rectangular patch antennas which have a common plate (i.e. the branch extending downwardly in FIG. 4(*a*)) so that the overall size is less than two individual patch antennas.

The length $l_v$ and width $w_v$ define the size of the plates forming the V in the Y-patch as shown. The $l_l$ and width $w_l$ define the size of the plate in common to both antennas also as shown. In general the lengths $l_v$, $l_l$ should be about $\lambda/4$ and the widths $w_v$, $w_l$ less than $\lambda/2$ and these follow the general guidelines of patch antennas. The angle of the Y in the diversity antenna is denoted $\Theta_\gamma$ and the position of the feeds is indicated by $x_1$ and $x_2$.

The design in FIG. 4 is generally more compact than two patch antennas or a square patch but larger that two PIFAs.

Figure 5A:
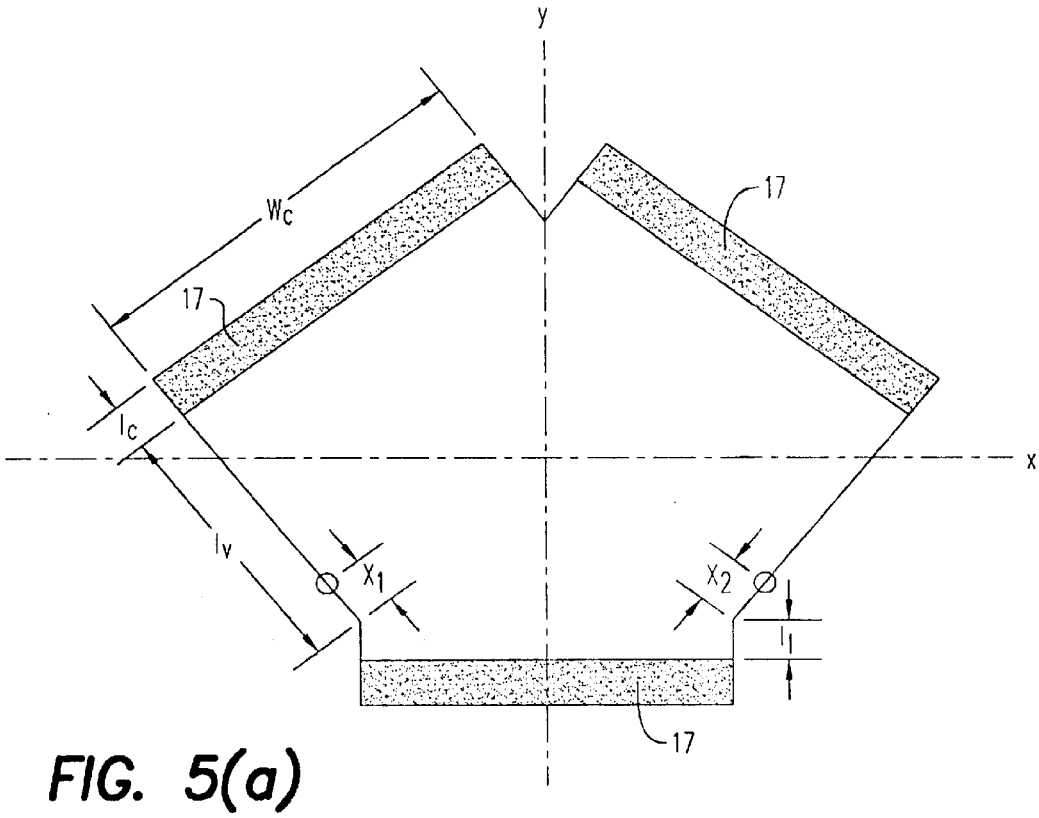
FIGS. 5(*a*)–(*b*) shows the geometry of a second embodiment of an antenna device according to the invention, in (*a*) planar view and (*b*) perspective view.
Figure 5B:
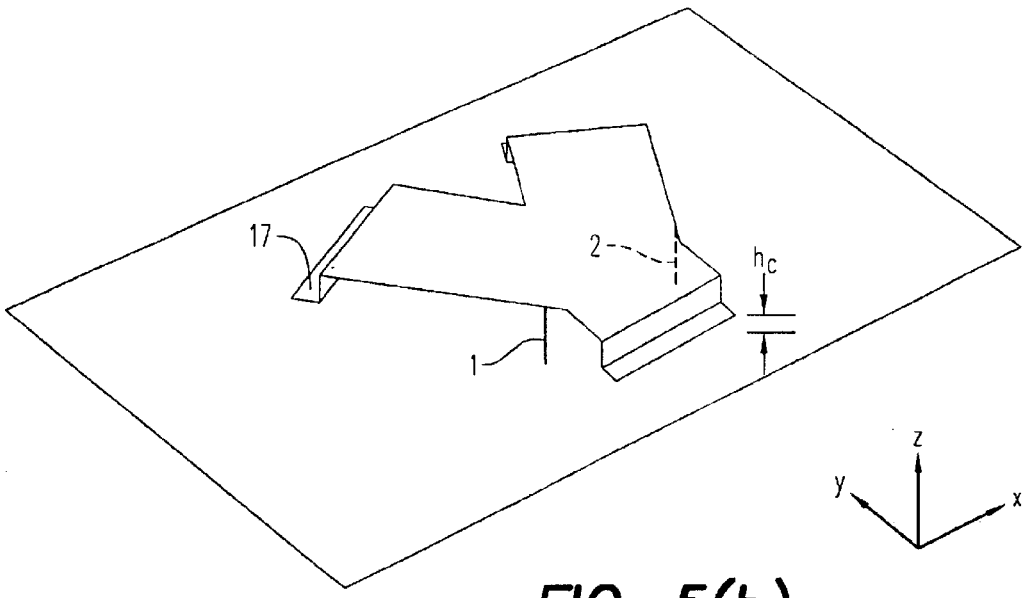

To reduce the size further, we propose a second embodiment of the invention, shown in FIGS. 5(*a*) and (*b*), in which capacitive loads 17 have been added to each branch of the plate, using the principles of C. R. Rowell and R. D. Murch, "A Capacitively loaded PIFA for compact mobile telephone handsets", IEEE Transactions on Antenna and Propagation, Vol 45, No.5, May 1997, pp.837–42. Each capacitative load is an element electrically connected to the respective branch of the plate, and including a plate portion parallel to the ground pate and spaced from it by a distance $h_c$. Here the size of the three capacitive loads 17 on each of the plates are the same with their width, length and height denoted as $w_c$, $l_c$ and $h_c$ respectively. The capacitive loads 17 permit the three branches to be shorter.

To better understand the operation of the patch we have performed simulations to obtain plots of the voltage distribution on our Y-patch antenna. The geometry utilized is the Y-patch without capacitive loads (as shown in FIG. 4) with dimensions $l_v$=31 mm, $l_l$=19 mm, $w_v$=$w_l$=17 mm, h=7 mm, $\Theta_\gamma$=75°.and $x_1$=$x_2$=9 mm. We used FDTD configured similarly to the paper of Rowell et al mentioned above, as well as M. T. K. Tam and R. F Murch, "Compact Sector and Annular Sector Dielectric Resonator Antennas", IEEE Transactions on Antennas and Propagation, Vol 47, No.5, May 1999, pp.837–842 (the disclosure of these citations being incorporated herein by reference). We obtained the voltage distribution across the patch at a resonant frequency of 2200 MHz when feed 1 acts as a source and feed 2 is open circuited. The results are shown as voltage contours (normalized to the maximum value) in FIG. 6, where an outline of the patch and feed positions are also provided. From the results it can be observed that a voltage null appears in the middle of the patch providing low coupling to the feed 2 supporting the discussion in section 2.

Figure 6:
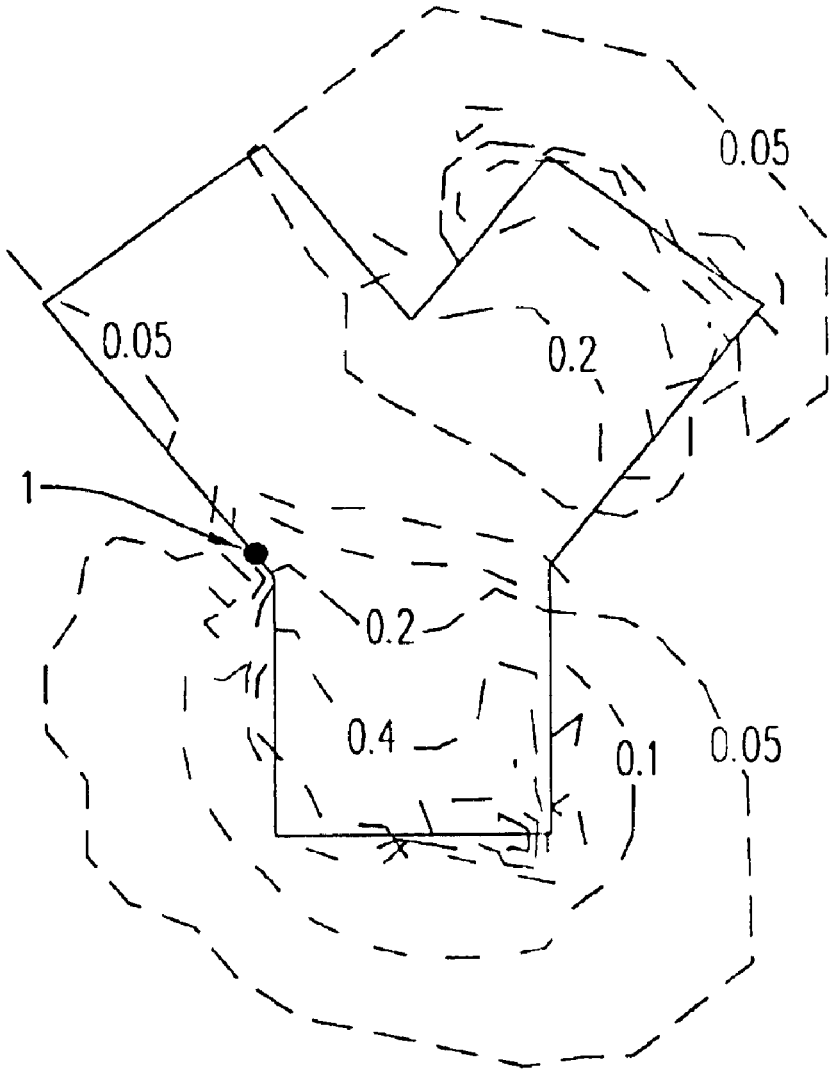
FIG. 6 shows the voltage distribution in the antenna of FIG. 5, obtained from an FDTD simulation. The voltage is normalized to the maximum value and $\Theta_\gamma=60°$.

In the first and second embodiments the antenna 7 is not directly electrically connected to the ground plate 13. However, FIG. 6 shows that this is not a necessary feature of the invention, since adding an electrical connection between the ground plate and the centre of the Y-shaped antenna (which is at 0 volts anyway) would not change the operation of the antenna.

A further possible variation to the embodiments within the scope of the invention can be noted by observing that in FIG. 5 the branches extend a relatively short distance from the centre of the Y-shape, compared to FIG. 4, so that is possible to form an embodiment which works to a certain extend with the branch portions of the transmission plate replaced by other electrical connections to the capacitive connections 17. The capacitive connections 17 would still be arranged circumfrentially spaced about the central region, which may for example be a shape having an edge facing towards each capacitive connection 17.

4. Experimental Results

We have also obtained experimental results of the capacitively loaded Y-patch and results of the radiation pattern, S-parameters and signal correlations for a design operating at 2200 MHz and provided. Using these measurements we evaluate the cross-correlations using the three formulas (2), (5), (7) and verify that the Y-patch has low mutual coupling. Estimates of the mean effective gain are also provided using formulas (1) and (6).

Figure 7A:
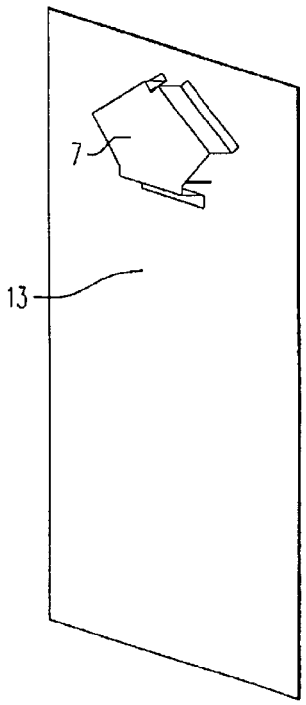
FIGS. 7(*a*)–(*b*) illustrates the antenna of FIG. 5 integrated into a mobile handset, with (*a*) the antenna on the circuit board and (*b*) the circuit board housed in a handset.
Figure 7B:
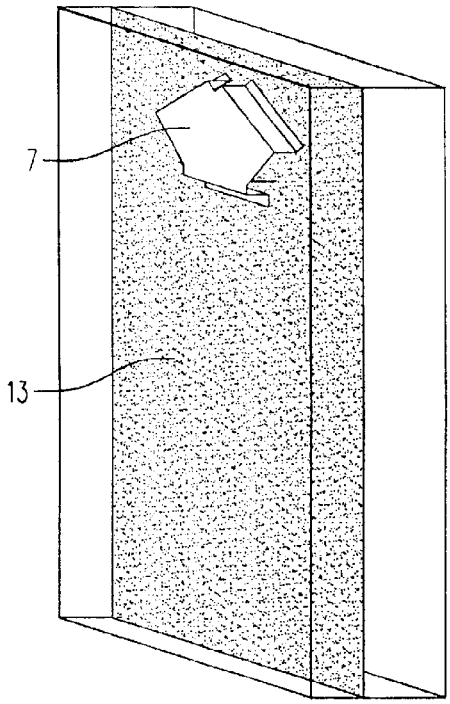

The dimensions of the capacitively Y-patch we utilize are $w_v$=$w_l$=17 mm, $l_l$=4 mm, $l_y$=13 mm, h=7 mm, $\theta_\gamma$=75°, $x_1$=$x_2$=5 mm and the three capacitive loads have dimensions w+c=17 mm, $l_c$=1 mm, $h_c$=1 mm. The antenna is constructed from copper tape in which a plastic chassis is used as a framework. The antenna 7 is placed on a ground plane 13 of 100 mm×50 mm and this would form the printed circuit board for receiver or transmitter components and a possible configuration is shown in FIG. 7. In our diversity antenna design the total top plate area is 484 $mm^2$ and in addition no special placement or separation of multiple elements is necessary since the diversity system is a single entity. Comparing this size to a diversity system with two conventional PIFA's and using the design in M. A. Jensen et al (the paper referred to above) scaled to 2200 MHz the overall top plate area would be 550 $mm^2$ (two sets of a single PIFA with scaled dimensions of 25×11=275 $mm^2$ and height 5 mm. We can therfore conclude that the present antenna requires a slightly smaller area and in addition offers the advantage of not needing any special antenna placement or element separation. Therefore, we believe the antenna is suitable for use in handsets where diversity is necessary.

(a) S-Parameters and Mutual Coupling

Measurement of the S-parameters for our embodiments were made using an HP8753D network analyzer. The S-parameters can also be used to determine the mutual impedance $Z_{12}$ so that an estimate of the correlation using (7) can be obtained.

Figure 8A:
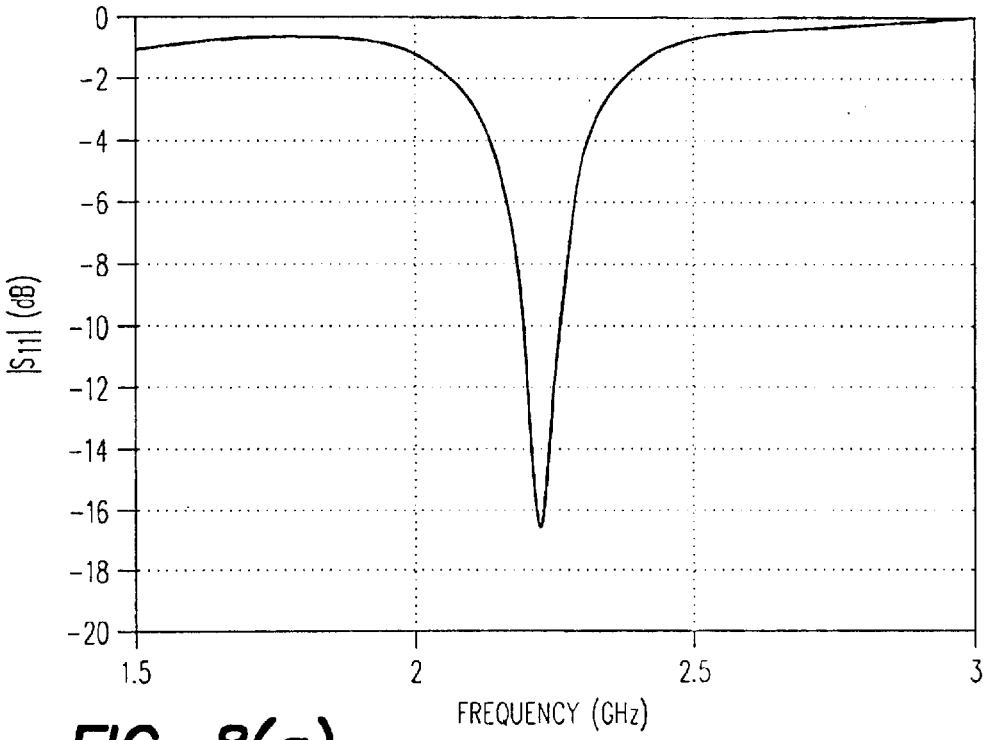
FIGS. 8(*a*)–(*b*) shows the return loss, more specifically (*a*) $|S_{11}|$ and (*b*) $|S_{22}|$, in the case of the antenna of FIG. 5 with $\Theta_\gamma=75°$.
Figure 8B:
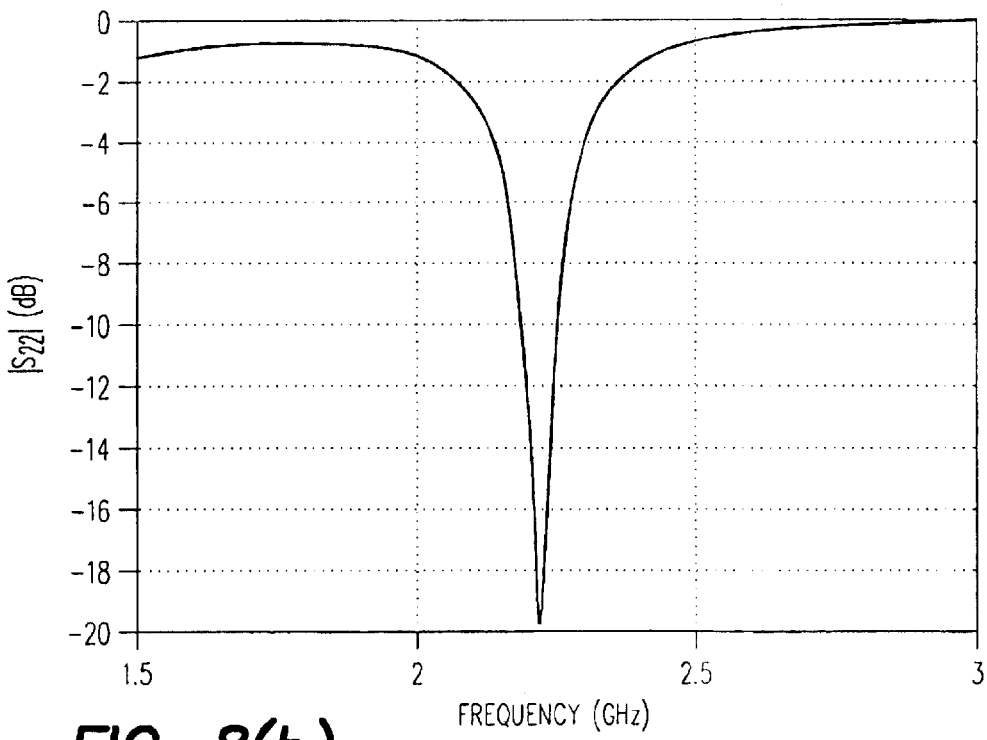

In FIGS. 8(*a*) and 8(*b*) we plot respectively the return loss $|S_{11}|$ and $|S_{22}|$ of our capacitively loaded Y-patch design and these show that the center frequency is 2200 MHz and the bandwidth of the antenna with return loss less than −10 dB for both ports is around 60 MHz.

Figure 9:
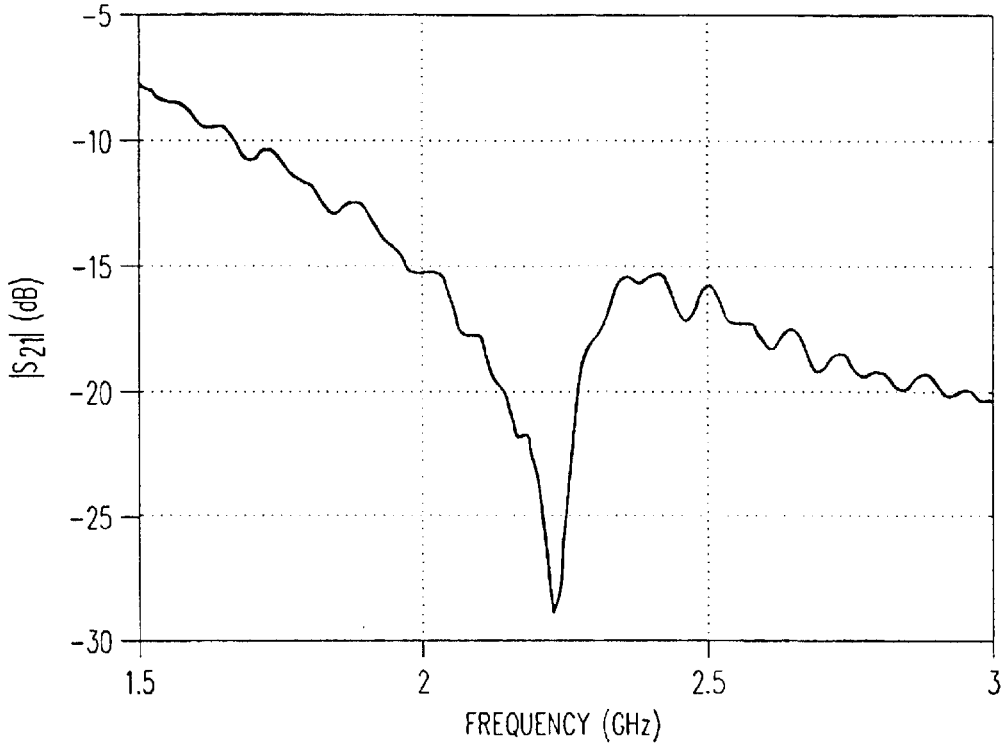
FIG. 9 shows the isolation $|S_{21}|$ between the 2 ports of the antenna of FIG. 5 with $\Theta_\gamma=75°$.

The coupling between the antennas $|S_{21}|$ is shown in FIG. 9 and the isolation between the ports at 2220 MHz is more than 28 dB. The isolation is greater than 20 dB across the entire band where $|S_{11}|$ and $|S_{22}|$ are less than −10 dB. The corresponding mutual resistance $Re(Z_{21})$=3.38Ω and from (7) we deduce that, the envelope correlation is 0.0046 and easily meets the correlation requirement of $\rho_e$<0.5 for achieving diversity.

We have also obtained results for the effect of different $\theta_\gamma$ on $|S_{21}|$ and these are listed in table 1. They indicate that when $\theta_\gamma$=75° the largest isolation between the 2 ports is obtained. The exact reason for this is not clear but it is likely at $75^+$ the area for which the null voltage region occurs is greatest.

TABLE 1

| | $\theta_y$ = 60° | $\theta_y$ = 75° | $\theta_y$ = 90° | $\theta_y$ = 105° | $\theta_y$ = 120° |
|---|---|---|---|---|---|
| $\|S_{11}\|$ (dB) | −18 | −31 | −19 | −22 | −17 |
| $\|S_{22}\|$ (dB) | −18 | −25 | −24 | −41 | −18 |
| $\|S_{21}\|$ (dB) | −14 | −35 | −12 | −24 | −28 |

Figure 10:
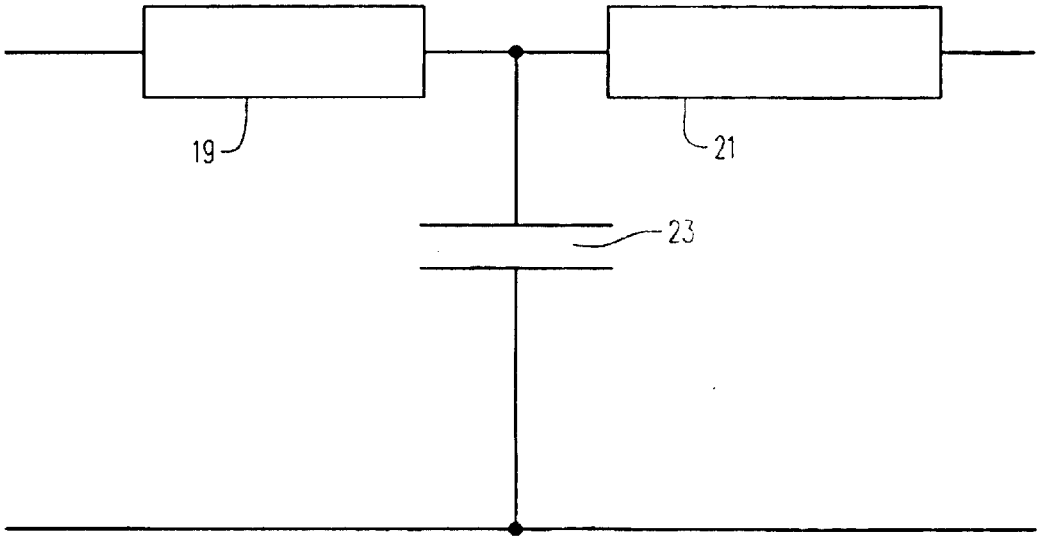
FIG. 10 shows a matching network for use in the first and second embodiments of the invention.

We have also investigated whether a matching network can extend the bandwidth of our antenna. With a 3 component matching network with one capacitor, and inductors at each port, the −10 dB $S_{11}$ and $S_{22}$ bandwidth can be doubled while still maintaining more than −20 dB isolation between ports. Such a matching network is shown in FIG. 10. The matching network has an input (outputs) on the upper-left connected to the combination/processing unit 5, and a two outputs on the upper right connected to respective conductors of the coaxial port. The output on the upper right of FIG. 10 is the one which extends to become the feed to the transmission plate. The lowest line on FIG. 10 thus represents a connection to ground. The circuit on FIG. 10 includes inductors 19, 21, with respective values of 21 nH and 35 nH, and a capacitor 23 of value 1 pF.

b) Radiation Patterns

Figure 11:
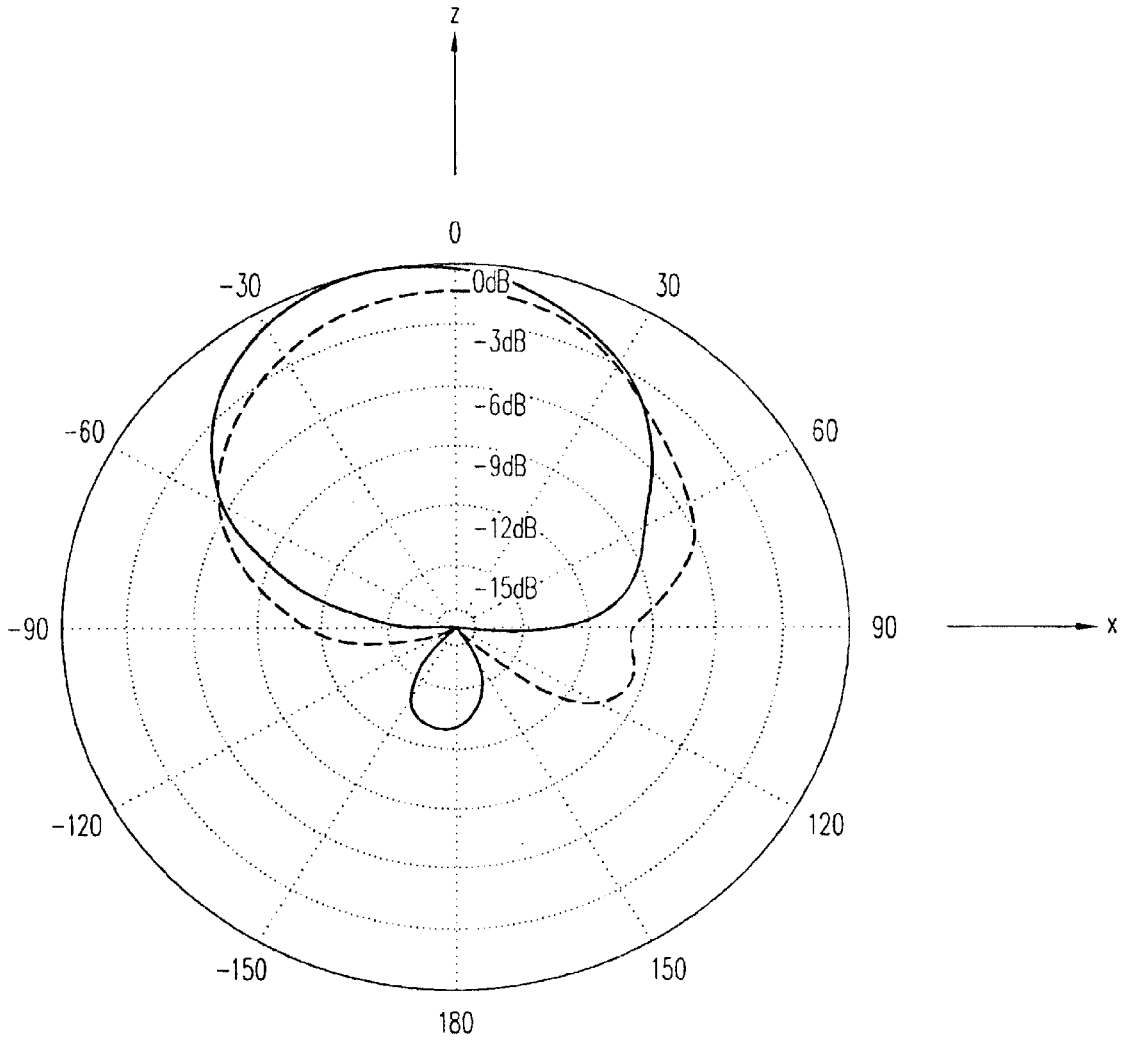
FIG. 11 shows the radiation pattern of the antenna of FIG. 2 with $\Theta_\gamma=75°$ for port 1, the solid and broken lines respectively representing $E_\Theta$ and $E_\varphi$ results.

The radiation patterns for the Y-patch are measured in an Anechoic Chamber also utilizing an HP8753D network analyzer. Using the orientation in FIG. 5 we obtain radiation patterns of both $E_\theta$ and $E_\phi$ along the x-z plane. The results for feed 1 at 2220 MHz are presented in FIG. 11. Because of the symmetry of the antenna, the radiation pattern for feed 2 is exactly the same but reflected in the line of symmetry along the y-axis.

By using (5), the real part of the envelope correlation between the 2 ports is found to be 0.0024 which is in approximate agreement with the results found in section 4(*a*). It should be noted that although the magnitude of the patterns from feed 1 and feed 2 are similar their phase patterns, although satisfying the antenna symmetry, are sufficiently different to produce the low cross correlation result.

From the formula (6) MEG can also be estimated and the $MEG_1/MEG_2$ ratio=1.047 dB indicating that the Y-patch satisfies the criteria for diversity (4). Under the wireless propagation conditions, we can assume that this is the same as the ratio $P_1/P_2$. We have thus shown that the difference between the average received signal strengths at the ports is less than 2 dB making this design suitable for diversity applications.

(c) Signal Cross-Correlations

Direct measurement of the signal cross correlation of the capacitively loaded Y-patch antenna has also been performed for an indoor environment. The measurements are performed in a similar way to those described in M. LeFevre, M. A. Jensen and M. D. Rice, "Indoor measurement of handset dual-antenna diversity performance", 1997 IEEE 47th Vehicular Technology Conference, Vol. 3, 1997, pp.1763–7, and C. Braun, M. Nilsson and R. D. Murch, "Measurement of the interference rejection capability of smart antenna on mobile telephones", 1999 Vehicular Technology Conference, May 16–19, 1999 (these two citations are incorporated herein by reference). In this approach an important simplification of the measurement process is performed by directly measuring envelope correlation rather than the complex correlation by making use of (3).

To perform the measurements a transmitter is configured at a fixed location consisting of a frequency generator (HP 8648C) connected to a horn antenna and set to a frequency of 2220 MHz with an output power of 20 dB. The transmitting antenna is positioned behind a metallic screen to help create a Rayleigh fading environment by avoiding a line-of-sight-path to the receiver.

The receiver consists of the Y-patch antenna in which the feeds are connected to the inputs of two synchronized HP 8536E spectrum analyzers. The spectrum analyzers are set to operate at zero span and single trace so that the time domain received signal envelope for each feed is approximately sampled at 30 samples/second over a 20 second interval giving 600 samples for each port. These samples are then downloaded to a computer for further processing using a GPIB interface.

During the measurements the receiving antenna was held in talk position, by a real person, and 20 sets of 20 second samples along various paths in the wireless communications laboratory at the Hong Kong University of Science and Technology were acquired. Once all the data had been acquired data processing was performed.

To remove the influence of path loss, shadowing and other long-term fading effects from the received signals a demeaning process. By "demeaning" we mean the following process which is known in this field. Firstly, we first calculate a moving average of the time-varying signal by calculating the short term mean in a window around each point (similar to say calculating a 60 day moving average in financial circles); we then subtract this moving average from the original signal to obtain the "demeaned" signal, representing the short term variations in the signal.

Figure 12:
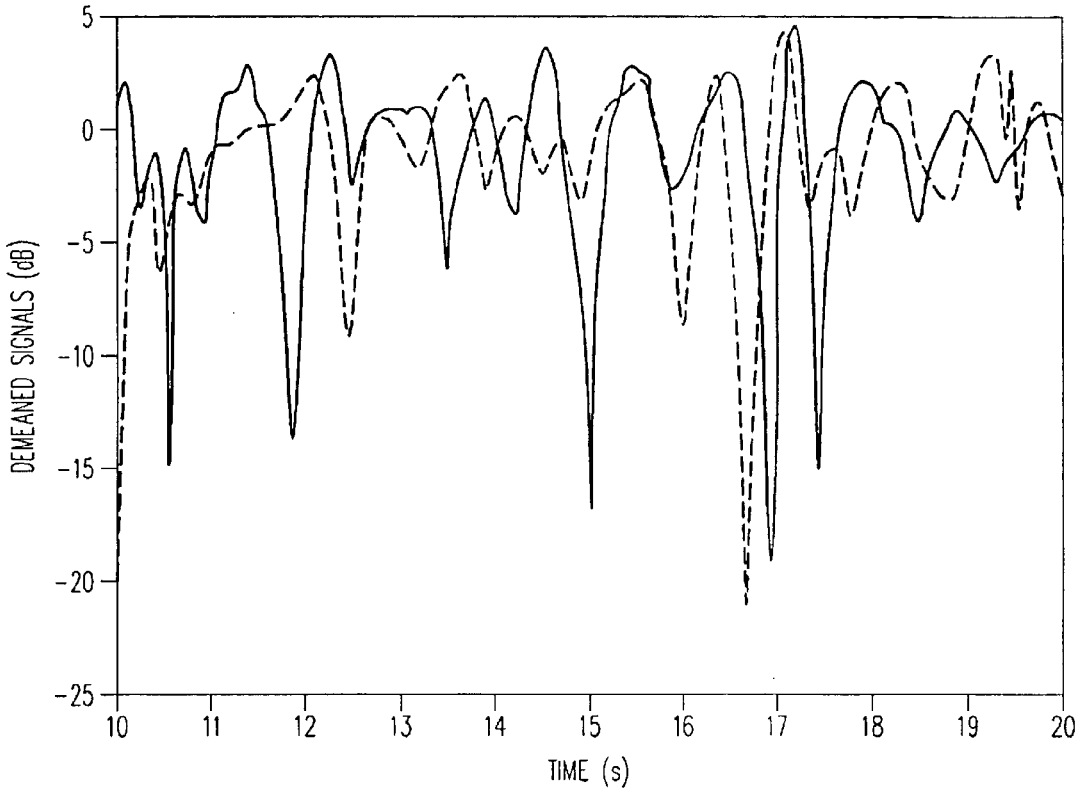
FIG. 12 shows time-varying envelope signals from the embodiment of FIG. 5, the solid and broken lines respectively representing the signals from ports 1 and 2.

A typical demeaned envelope from a particular path is shown in FIG. 12. FIG. 12 was produced using a demeaning window of 1 second corresponding to a displacement of about 1 m.

The computation of the envelope correlation coefficient for the measured envelopes is performed using (2) and the envelope correlation is found to be 0.0860 but still within our limit (4). One reason why the envelope correlation is higher than that measured in section 4(*a*) and 4(*b*) is that we held the antenna in talk position and that a line of sight path may have existed.

The mean signal levels from the two ports were also obtained and are 55.67 dBm and −53.99 dBm respectively. This gives a difference of 1.68 dB and is also well within our criteria for ensuring good diversity gain (4).

Industrial Applicability

Potential applications of the invention include handsets for third generation (3 G) wireless systems, Enhanced Data Rates for GSM Evolution (EDGE) and wireless internet systems where high data rates may make diversity at the handset important.

Although only a few embodiments of the invention have been described in detail, the scope of the invention is not limited to these embodiments, but is according to the appended claims. In particular a number of variations are possible within the scope of the invention as will be clear to a skilled person. For example, in the embodiments described above at 2200 MHz the bandwith is 60 MHz, and in alternative embodiments this should be increased to meet the needs of a 3 G system operating in the bands 2100–2300 MHz. Matching has been shown to be capable of doubling the bandwidth, but other geometries using parasitics may provide greater bandwidth. Multiple band operation is also desirable and various modifications to the geometry may be considered in order to meet this requirement.

In one embodiment of the invention, multiple sets of the diversity antenna are arranged (e.g. as a regular array) to provide an antenna system with 4, 6, 8 or more ports for antenna processing.

What is claimed is:

1. An antenna device comprising:

(a) a first conducting plate forming a transmission plate of the antenna device, the first conducting plate being shaped to include a central portion and first, second and third branch portions, said first, second and third branch portions extending from the central portion in respective first, second and third directions, the first, second and third directions being circumferentially spaced around the central portion;

(b) a second conducting plate arranged substantially parallel with the first conducting plate and forming a ground conductor of the antenna device; and (c) two electrical connection devices, each of said connection devices being electrically connected to a respective connection portion of the central portion of the first conducting plate, one said connection portion being between the first and third branch portions, and the other said connection portion being between the second and third branch portions.

2. An antenna device according to claim 1 in which the third direction defines a longitudinal axis, and said first and second directions are symmetrically arranged on respective sides of said axis.

3. An antenna device according to claim 2 in which said central portion subtends an angle between said first and second directions of substantially 75°.

4. An antenna device according to claim 2 in which said central portion of the antenna has oppositely facing edges on either side of said axis, and said connection portions are respectively proximate said edges.

5. An antenna device according to claim 2 in which said central portion of the antenna has oppositely facing edges on either side of said axis, and said connection portions are respectively at said edges.

6. An antenna device according to claim 1 in which at least one of said branch portions is provided with a capacitative connection to said second conducting plate.

7. An antenna device according to claim 1 in which each of said branch portions is provided with a respective capacitative connection to said second conducting plate.

8. An antenna device according to claim 7 in which the capacitative connection between each branch portion and the second conducting plate is at a portion of the branch portion furthermost from said central position.

9. An antenna device according to claim 1 further including a matching network connected to each said connection portion.

10. An antenna device according to claim 1 further including an electric connection between said ground plate and said central position of said transmission plate.

11. A mobile communications device incorporating an antenna device comprising:

(a) a first conducting plate forming a transmission plate, the first conducting plate being shaped to include a central portion and first, second and third branch portions, said first, second and third branch portions extending from the central portion in respective first, second and third directions, the first, second and third directions being circumferentially spaced around the central portion;

(b) a second conducting plate arranged substantially parallel with the first conducting plate and forming a ground conductor;

(c) two electrical connection devices, each of said connection devices being electrically connected to the central portion of the first conducting plate at respective connection location, one said connection location being between the first and third branch portions, and the other said connection location being between the second and third branch portions; and (d) a processing block which receives respective signals from the two connection devices, and combines them to derive an improved signal.

12. A mobile communications device comprising:

(a) a first conducting plate forming a transmission plate, the first conducting plate being shaped to include a central protion and first, second and third branch portions, said first, second and third branch portions extending from the central portion in respective first, second and third directions, the first, second and third directions being circumferentially spaced around the central portion;

(b) a second conducting plate arranged substantially parallel with the first conducting plate and forming a ground conductor, (c) two electrical connection devices, each of said connection devices being electrically connected to the central portion of the first conducting plate at respective connection locations, one said connection location being between the first and third branch portions, and the other said connection location being between the second and third branch portions; and (d) a processing block which processes a first signal received from a first of the connection devices, and a transmission block which transmits a second signal to the other of the connection devices.

13. A mobile communications device comprising:

(a) a first conducting plate forming a transmission plate, the first conducting plate being shaped to include a central portion and first, second and third branch portions, said first, second and third branch portions extending from the central portion in respective first, second and third directions, the first, second and third directions being circumferentially spaced around the central portion;

(b) a second conducting plate arranged substantially parallel with the first conducting plate and forming a ground conductor, (c) two electrical connection devices, each of said connection devices being electrically connected to the central portion of the first conducting plate at respective connection locations, one said connection location being between the first and third branch portions, and the other said connection location being between the second and third branch portions; and (d) a signal transmission block which transmits a first signal to a first of the connection devices, and a second signal to the other of the connection devices.

14. An antenna device comprising:

(a) a first conducting plate forming a transmission plate of the antenna device, (b) a second conducting plate arranged substantially parallel with the first conducting plate and forming a ground conductor of the antenna device;

(c) first, second and third capacitive elements circumferentially spaced around the central portion of the first connecting plate, each of said capacitive elements being electrically connected to the first connecting plate and capacitively coupled to the second conducting plate; and (d) two electrical connection devices, said connection devices both being electrically connected to the first transmission plate at respective locations on the central portion of the first conducting plate, one said connection location being between the first and second capacitative elements, and the other said connection location being between the first and third capacitive elements.

* * * * *